United States Patent [19]

Hackett

[11] Patent Number: 4,915,381

[45] Date of Patent: Apr. 10, 1990

[54] BASKETBALL TARGET DEVICE

[76] Inventor: Mark C. Hackett, 37 Moon Ave., Brewer, Me. 04412

[21] Appl. No.: 267,453

[22] Filed: Nov. 3, 1988

[51] Int. Cl.[4] ..... A63B 63/08

[52] U.S. Cl. ..... 273/1.5 A; 273/389

[58] Field of Search ..... 273/1.5 A, 386, 389, 273/58 C, 29 A, 26 A, 26 E, 26 EA

[56] References Cited

U.S. PATENT DOCUMENTS

| | | | |
|---|---|---|---|
| 3,173,687 | 3/1965 | Hair | 273/1.5 A |
| 3,348,840 | 10/1967 | Dix | 273/1.5 A |
| 3,630,521 | 12/1971 | Lingbeek et al. | 273/58 C |
| 4,213,606 | 7/1980 | Wilson | 273/1.5 A |
| 4,226,416 | 10/1980 | Callanan | 273/1.5 A |
| 4,244,569 | 1/1981 | Wong | 273/1.5 A |
| 4,506,886 | 3/1985 | Lamb | 273/1.5 A |

*Primary Examiner*—Paul E. Shapiro

[57] ABSTRACT

An aiming device to assist in basketball shooting practice, comprised of an elastic cord, fasteners at both ends of the cord for detachably fastening the ends of the line to the hoop of a basketball goal, so that the line spans the hoop opening and lies in the plane of the circle defined by the hoop, and a visible aiming target mounted on the line and centered on the axis of the hoop, whereby a ball will pass unimpeded, through the rim, but will deflect the target so as to provide feedback to the player as to how to improve his shooting. The target is rotatably held on the line and is preferably a hollow, brightly colored plastic ball through which the line is passed.

3 Claims, 1 Drawing Sheet

BASKETBALL TARGET DEVICE

BACKGROUND OF THE INVENTION

This invention relates to a target device for improving the shooting accuracy of a basketball player.

Various training devices for basketball players employ the use of a target to aid shooting accuracy. Deflectable training targets such as that disclosed in U.S. Pat. Nos. 4,244,569 (Wong) and 4,506,886 (Lamb) disclose an object such as a brightly colored ball positioned either below, adjacent to or above the rim of the backboard. These employ complicated mechanical mountings positioned above or below the rim to hold the target in place.

In addition to devices of the type just described, the prior art also contains basketball shooting and rebounding devices which employ elastic or resilient materials to deflect the ball from the goal or otherwise to prevent the basketball from descending through the goal.

Wong states that a target "could easily be positioned along the axis of the hoop, but a simple mounting of a target thereat could interfere with play by preventing a basketball from descending through the hoop."

The use of elastic or resilient material positioned along the axis of the hoop that allows passage of a basketball through the goal has not been recognized by the prior art.

Feedback to the basketball player from previous target devices falls into one of two categories. The first category, shooting rings, (Lamb and others), allows only perfect shots to descend through the goal. It is known that many "imperfect" shots may also descend through the goal, but this first category of targets deflects these shots, giving negative feedback to the basketball shooter. The second category, (Wong), allows the player to sink the ball through the goal without properly hitting the target device. Although the player shot an imperfect shot, the goal was achieved, but little or no constructive feedback was relayed back to the player. Thus, very limited feedback occurs from either category of prior art shooting device.

The complicated mechanical mountings of prior art shooting devices limit usage to shooting practices only since these mounting devices require significant modifications of conventional backboards and/or rims.

I have found that it is much more beneficial for the basketball player to learn to shoot during simulated game conditions. A player who must play defense, rebound, and play offense is usually at a greater fatigue level than he/she would be if only participating in shooting practice. The cumbersome mechanical mounting devices could present safety hazards to players if used during simulated game conditions. These devices also look very different from the actual official basket. It is clear that a target holding device which did not alter the original hoop and backboard would be much safer. Also, a less cumbersome and fully portable device is needed.

SUMMARY OF THE INVENTION

In response to the above need, I have provided a simple, portable basketball shooting device that may be removably attached to any basket for use during simulated game conditions, as well as shooting practices, and also will provide positive feedback to the player for all shots, imperfect and perfect, that would normally descend through the goal.

According to the invention, the aiming device is an elastic line, strap or band with hooks or other gripping devices at the ends for securing to opposite sides of the rims with the elastic line or band spanning the diameter of the rim. At the center of the elastic line or band is the aiming target, typically a small hollow brightly colored plastic ball constrained to limit lateral motion in either direction by washers or other stops so that the aiming target remains substantially at the center of the circle defined by the rim. The elastic line or band passes through the center of the brightly colored hollow plastic ball and the ball is mounted so that it can rotate around the elastic line or band for easily passing a basketball through the rim.

With the aiming device secured in place on a basketball rim, the length and elasticity of the line or band are selected to give way easily to a basketball passing through the rim. The rotation of the brightly colored plastic target ball at the center of the elastic line or band facilitates passage of the basketball without substantial interference. The high visibility aiming object then returns quickly to its center position upon recovery of the elastic line or band. The aiming device is easily converted into a rebounding device by adding additional elastic lines through the target spanning the diameter of the rim in equidistant directions.

Still further objects, features and advantages of the invention will become apparent from the following detailed description of a presently preferred embodiment thereof taken in conjunction with the accompanying drawings.

DETAILED DESCRIPTION OF PREFERRED EMBODIMENT

Figure 1A:
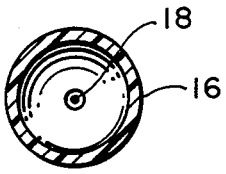
FIG. 1 is a view in perspective of one embodiment of the novel basketball practice shooting device of the invention.

The target 16, in the form of a colored (including white and black) ball, or object, is positioned by an elastic cord 18 at the axis and in the plane of the rim 10 and attaches to the rim or its flanges, centered above the basket net 12. The target 16, centered by the elastic material in the rim, may be nothing more than a spot (or dot) on the elastic cord itself, but is preferably a brightly colored ball through which the cord passes and which is free to spin about the cord.

The elastic cord 18 may be detachably mounted on the rim 10 by fastening means 20 which may comprise, for example, ordinary hooks 20B or snap hooks 20A. A wide variety of fasteners will be found to be suitable. If the hook does not exactly fit the rim or flange the cord may be passed around the same and the hook hooked upon the cord itself. The device also may be attached to the flanges by looping the ends of the elastic line thereby negating the need for additional attachment hardware (hooks, etc.).

The target yields to basketball contact and because of the elastic property of the device, an imperfect shot descending through the goal will move the object (target) in the direction of a more perfect shot, thus giving feedback to the player as to how to improve his shooting. The elastic device is preferably ordinary elastic shock cord lined across a diameter of the rim so that the target is deflectably held normally at the center of the rim and in its plane.

After being deflected by the passage of a ball, the target returns to its starting point within hundredths of a second which allows many players to shoot at once without waiting. The player gets positive feedback and knows whether or not his/her shot was perfect or imperfect. In the event of an imperfect shot he/she knows that he should aim more in the direction that the target moved. The player also receives the knowledge that the slightly imperfect shot would still have made a goal in game conditions. This knowledge may prevent the player from becoming discouraged. The player gets aiming feedback with each shot, but does not become too frustrated which might easily happen if the target accepted only perfect shots.

For low skill level players, the target should usually be larger than in the case of expert players and it should rotate about the axis of the elastic material to allow easy passage of the basketball. Thus, a rotatable ball can be positioned at the rim axis by crimps, washers or similar hardware. As the player progresses in skill, a smaller ball or object will be used as a target. Depending on the size of the target, the ball will either rotate or be fixed to the elastic material. The target may become a colored mark on the elastic material itself for very expert players.

Many variations of elastic material may be used and a mixture of rope/cord/etc. and elastic material may be used or even alternated to suspend the target. On fixed targets, multiple strands of elastic material may be used to suspend the target as long as the target still is readily deflectable to allow the basketball to pass through the goal. A lighted target or varied colors of the target such as phosphorescent may be used to allow twilight games outdoors. If desired, a white target, similar in color to the net, may be used for players who might have difficulty adjusting to the removal of a brightly colored target.

Various types of mounting hardware ma be used to attach the elastic cord to the rim or its flanges.

It will be seen, therefore, that the invention provides a basketball shooting device well adapted to improve shooting accuracy, which is safe, and which may be used during simulated game conditions. The device will provide constructive feedback on imperfect yet scoring shots to the player. It may be manufactured at low cost so as to allow universal usage, as compared with the cost of comparable prior art devices. Its single assembly may be readily mounted on and removed from any existing basketball goal and backboard within seconds without the use of tools. It allows unobstructed shooting at the target device from all positions in the playing area, and helps to teach the player to shoot with more of an arc.

I claim:

1. In combination with the hoop of a basketball goal an aiming device for attachment to the hoop to assist in basketball shooting practice which comprises a single elastic cord, means at both ends of said cord for detachable fastening to said hoop so that the cord spans the center of the hoop opening and lies in the plane of the circle defined by the hoop, and a visible aiming target on said cord centered on the axis of said opening, said opening being free of obstructions other than said cord and target whereby a ball will pass unimpeded through the hoop but will deflect the target so as to provide feedback to the player as to how to improve his shooting.

2. The aiming device of claim 1 wherein the target is a small hollow brightly colored plastic ball.

3. The device of claim 2 wherein said target is provided with an opening through which said cord is passed whereby the target is rotatably held on said cord.

* * * * *

UNITED STATES PATENT AND TRADEMARK OFFICE

CERTIFICATE OF CORRECTION

PATENT NO. : 4,915,381

DATED : April 10, 1990

INVENTOR(S) : Mark C. Hackett

It is certified that error appears in the above-identified patent and that said Letters Patent is hereby corrected as shown below:

Col. 2 line 39, after "invention" insert new paragraph

Figure 1:
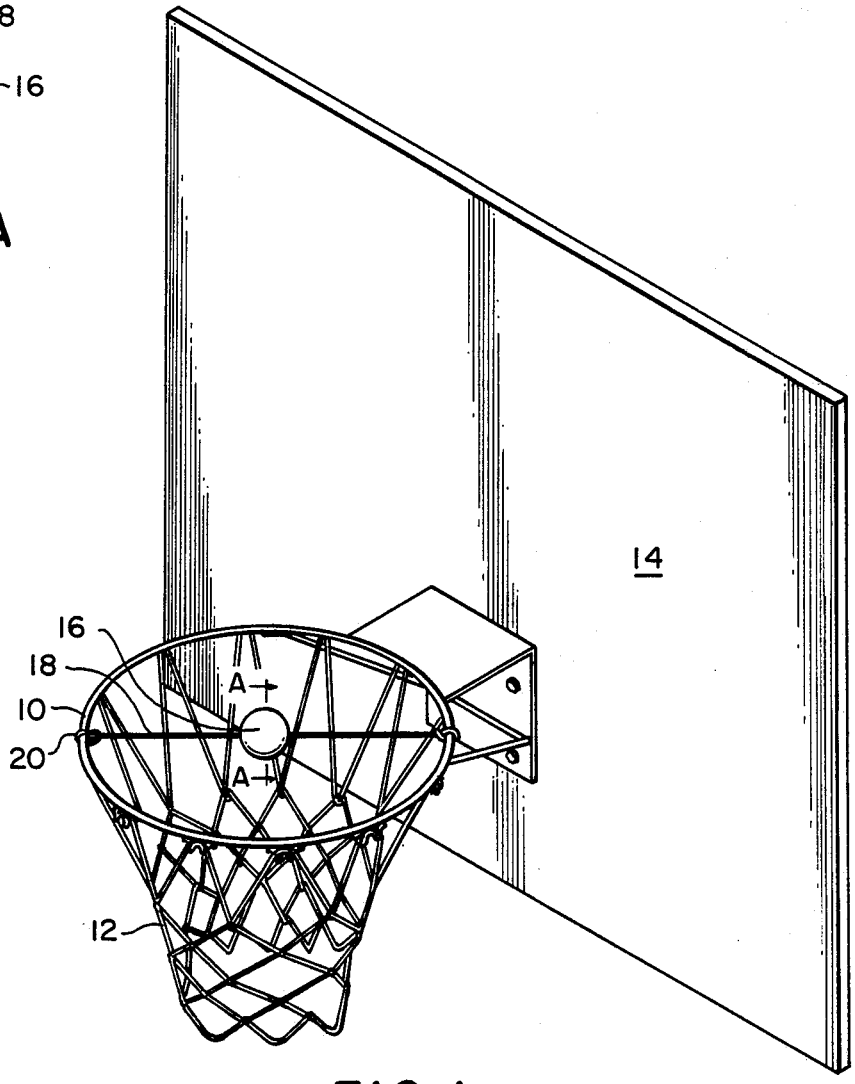
Figure 2:
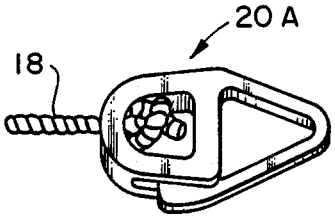
FIG. 2 and FIG. 3 are elevational views on an enlarged scale of two different forms of fastening means for use in attaching the device to the basket rim.
Figure 3:
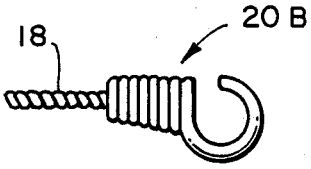

-- Fig. 1A is a cross-sectional view of the target itself on line indicated by the letter A in Fig. 1; and --

Col. 4 line 3 change "ma" to -- may --

Signed and Sealed this

Seventeenth Day of March, 1992

*Attest:*

HARRY F. MANBECK, JR.

*Attesting Officer*

*Commissioner of Patents and Trademarks*